US005495113A

United States Patent [19]

Badiali et al.

[11] Patent Number: 5,495,113

[45] Date of Patent: Feb. 27, 1996

[54] METHOD AND DEVICE FOR MONITORING THE SOUNDNESS AND QUALITY OF A TWISTED YARN

[75] Inventors: Roberto Badiali, Pordenone; Mario Marascutti, Fontanafredda; Vittorio Colussi, Colle Umberto, all of Italy

[73] Assignee: Savio Macchine Tessili, Pordenone, Italy

[21] Appl. No.: 277,973

[22] Filed: Jul. 20, 1994

[30] Foreign Application Priority Data

Aug. 6, 1993 [IT] Italy ..... MI93A1795

[51] Int. Cl.[6] ..... G01N 21/00

[52] U.S. Cl. ..... 250/559.45; 356/430; 356/238

[58] Field of Search ..... 250/560, 561, 250/562, 571, 572, 221, 222.1, 559.12, 559.14, 559.4, 559.43, 559.45; 356/429, 430, 238

[56] References Cited

U.S. PATENT DOCUMENTS

| | | | |
|---|---|---|---|
| 2,991,685 | 7/1961 | Van Dongeren | 250/562 |
| 3,595,004 | 7/1971 | Saunders | 250/561 |
| 4,186,309 | 1/1980 | Gnuechtel | 250/561 |
| 4,311,916 | 1/1982 | Schenkel | 250/561 |
| 4,436,427 | 3/1984 | Schwartz | 250/560 |
| 4,743,749 | 5/1988 | Grundy | 250/561 |
| 4,772,800 | 9/1988 | Kanai et al. | 250/561 |
| 5,015,867 | 5/1991 | Siegel et al. | 250/560 |
| 5,017,797 | 5/1991 | Uramoto et al. | 250/561 |

FOREIGN PATENT DOCUMENTS

| | | |
|---|---|---|
| 2267399 | 11/1975 | European Pat. Off. . |
| 282742 | 9/1988 | European Pat. Off. . |

*Primary Examiner*—Edward P. Westin
*Assistant Examiner*—John R. Lee
*Attorney, Agent, or Firm*—Robert D. Schaffer; Rogers and Wells

[57] ABSTRACT

The present invention provides a method for monitoring the soundness and quality of a twisted yarn produced in a double twist spindle of a twisting frame.

The invention also provides a device for implementing said monitoring of the soundness and quality of the twisted yarn which is produced in the spindle and undergoes the movement necessary to feed the bobbin under formation.

5 Claims, 3 Drawing Sheets

METHOD AND DEVICE FOR MONITORING THE SOUNDNESS AND QUALITY OF A TWISTED YARN

BACKGROUND OF INVENTION

1. Field of the Invention

This invention relates to a method and device for monitoring the soundness and quality of a twisted yarn produced in a double twist spindle of a twisting frame.

The invention is applicable to a double twist spindle for twisting together a number of yarns to form a twisted ply yarn. Said yarns can be of any composition or structure and will be known throughout the description and claims simply as yarns, whether they be in the form of filaments or filament complexes or natural or artificial fibres.

2. Description of the Related Art

The term "twist together" is used herein in the wide sense of combining two or more yarns, the wide sense including the twisting of ends of previously twisted single yarns. The invention is particularly useful for monitoring the twisting of two yarns, but can however be used for monitoring the twisted combination of three or more yarns, the limit being fixed only by practical considerations. It is well known that in a double twist spindle, the yarns to be twisted together are unwound upwards from at least two packages rotating about a fixed mandrel.

This well known unwinding operation has the drawback of causing the yarns to mutually interfere, they becoming interlaced before entering the central hole in the spindle to form loops, rings, corkscrew-like spiral parts and other shapes generally of this nature. It is also well known that yarns unwinding in a double twisting frame, especially at high speed, are exposed to a variation in tension, this latter sometimes becoming excessive. In the case of more than one yarn, whether yarns spun from staple or yarns formed from synthetic filaments, this excessive tension is undesirable because the yarns undergo severe stressing and rubbing contact on account of their mutual interference during their continuous unwinding from the feed packages, and consequently become excessively stretched, damaged or in the limit broken. In this respect, a single yarn often breaks, resulting in a yarn being collected which is no longer twisted with other yarns, hence leading to the formation of a defective bobbin. Such a defective bobbin compromises the subsequent working stages in the production process, and hence reduces the economy and productivity of plants of this kind. Again, the effect of mutual intersection and interweaving of the yarns and the effect of the said frequent sliding contact result in the formation of flying fibrils and sometimes loose yarn pieces which are often twisted together with the yarn, causing twisting defects. Double twist spindles of this type have the further drawback of being subjected to serious stressing due to the high rotational speed necessary to achieve maximum operating limits in terms of collection rate.

In operating current spindles, the often present wear and mechanical defects cause vibration and loss of spindle rpm, which directly affect the quality of the twisted yarn. In this respect, if this latter is formed in a twisting spindle which loses rotational speed for any mechanical reason, it becomes formed with an insufficient number of twists to provide correct strength, with resultant fairly frequent non-uniform twisting. This effect is undesirable because it ruins the appearance of the twisted yarn in that the individual yarn plies are loaded non-uniformly by the twisting. In the case of thin yarn subjected to particularly rapid unwinding, all this can produce breakage during the next stage of the production process.

SUMMARY OF THE INVENTION

To solve the aforesaid problems it has already been proposed in the art to use monitoring means of mechanical, optical or inductive sensor type suitable for sensing when the yarn twisted by the twisting spindle has undergone breakage. Said sensors suggested by the known art have proved to be not totally adequate in the sense of not providing information on the quality of the twisted yarn being collected, and in particular are unable to recognize when only a single-ply yarn exists, i.e., when one of the two yarn plies being twisted together is missing. Such yarn monitoring means hence have their limits.

In this respect it should be noted that as both the formation rate of the twisted yarn and the quality requirements of the market are in a state of continual increase, it is more important than before to provide suitable monitoring of the twisting operation, in particular with regard to the quality of the twisted yarn under formation. This problem is of great current interest and importance given that manufacturers increasingly seek to produce a perfect product.

The need for higher quality production has accentuated the aforesaid problems, which have existed for some time in the twisting field.

In accordance therewith and in the light of the defects and drawbacks of current arrangements proposed in the art, the present invention provides a method for monitoring the soundness and quality of a twisted yarn resulting from a number of yarns twisted together in a double twist spindle, said method including both detecting the lack of at least one of the individual yarn plies making up the moving twisted yarn which is winding onto a bobbin, and recognizing the presence of a portion of tangled yarn accidentally superposed on the twisted yarn under regular formation, and further detecting any reduction in the rpm of the spindle disc in that said reduction results in insufficient twist being applied to the twisted yarn, with the result that it has irregular appearance and insufficient strength. The method of the present invention is implemented in a device comprising an opto-electrical transducer associated with, and in proximity to, the known yarn guide eyelet, said transducer forming a measurement cell which is continuously self-calibrating with time and uses as optical monitor a light emitting diode for emitting modulated light.

According to an advantageous embodiment the opto-electrical transducer is arranged in a position replacing the known yarn guide eyelet, which is positioned vertically above and coaxial with the twisting spindle.

Further details and characteristics of the invention will be apparent from the description of one embodiment thereof illustrated on the two accompanying drawings, it being noted however that the invention can be implemented in the form of numerous other embodiments.

DESCRIPTION OF THE PREFERRED EMBODIMENT

Figure 1:
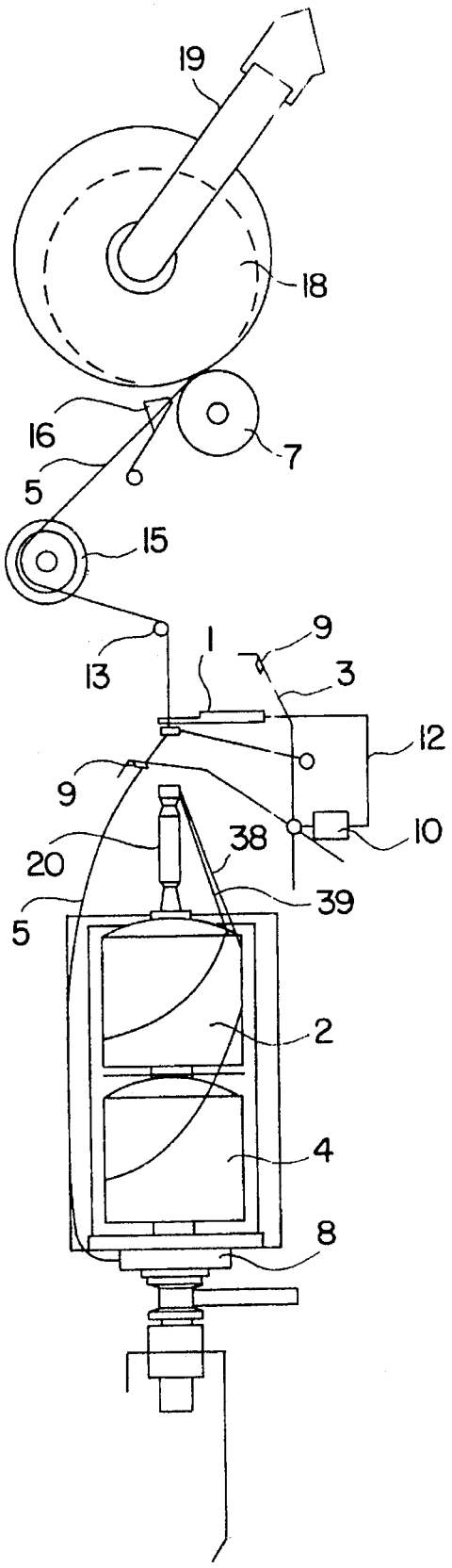
FIG. 1 is a schematic partial side view of a twisting spindle with two superposed packages feeding the yarn plies for forming the twisted yarn, which is collected on the frusto-conical bobbin under formation, said figure also schematically showing the opto-electrical transducer cooperating with an arm provided at the end of a cutting element for interrupting an irregular twisting yarn.

Those parts not necessary for understanding the invention are omitted from the figures for reasons of overall clarity. The feed packages 4 and 2 are superposed within the basket and maintained centered about the axis of the central pin 20 of the known twisting spindle. The yarns 38 and 39 unwound from the respective packages 4 and 2 are inserted jointly into the hole in the hollow pin 20.

The yarns 38 and 39 are twisted together and leave radially from the accumulator disc 8 to rise as twisted yarn 5 to the yarn guide eyelet 6, which determines the vertex of the balloon of said twisted yarn 5. This latter passes about the guide pins 13 and 15 to wind as cross turns onto the frusto-conical bobbin 18 under formation.

The bobbin 18 supported by the arm 19 rests on the drive roller 7, which rotates the bobbin by friction while simultaneously the yarn guide element 16 moves the twisting yarn 5 continuously to and fro, to deposit as turns on the surface of the bobbin 18 under formation, in well known manner.

Figure 2:
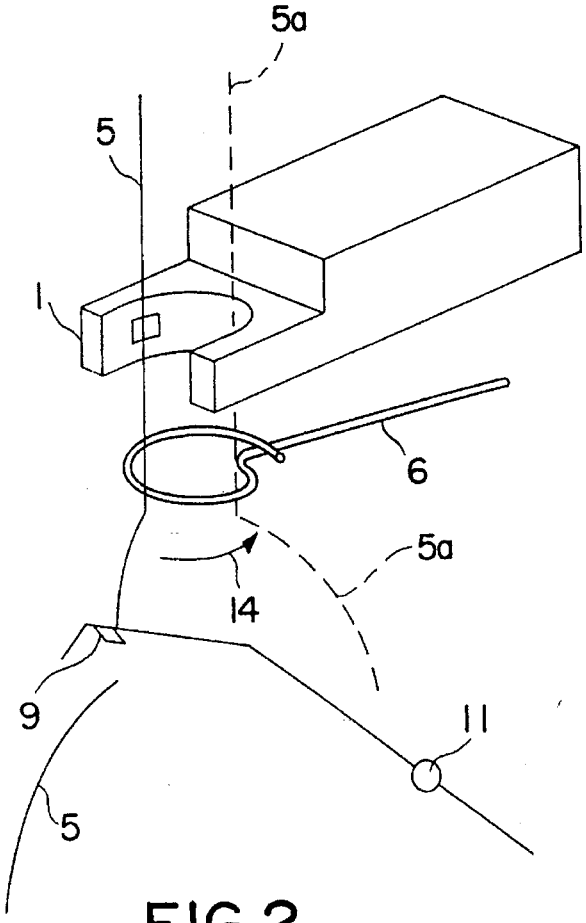
FIG. 2 is a schematic perspective view of the opto-electrical transducer associated with the yarn guide eyelet and the arm of the cutting element.
Figure 3:
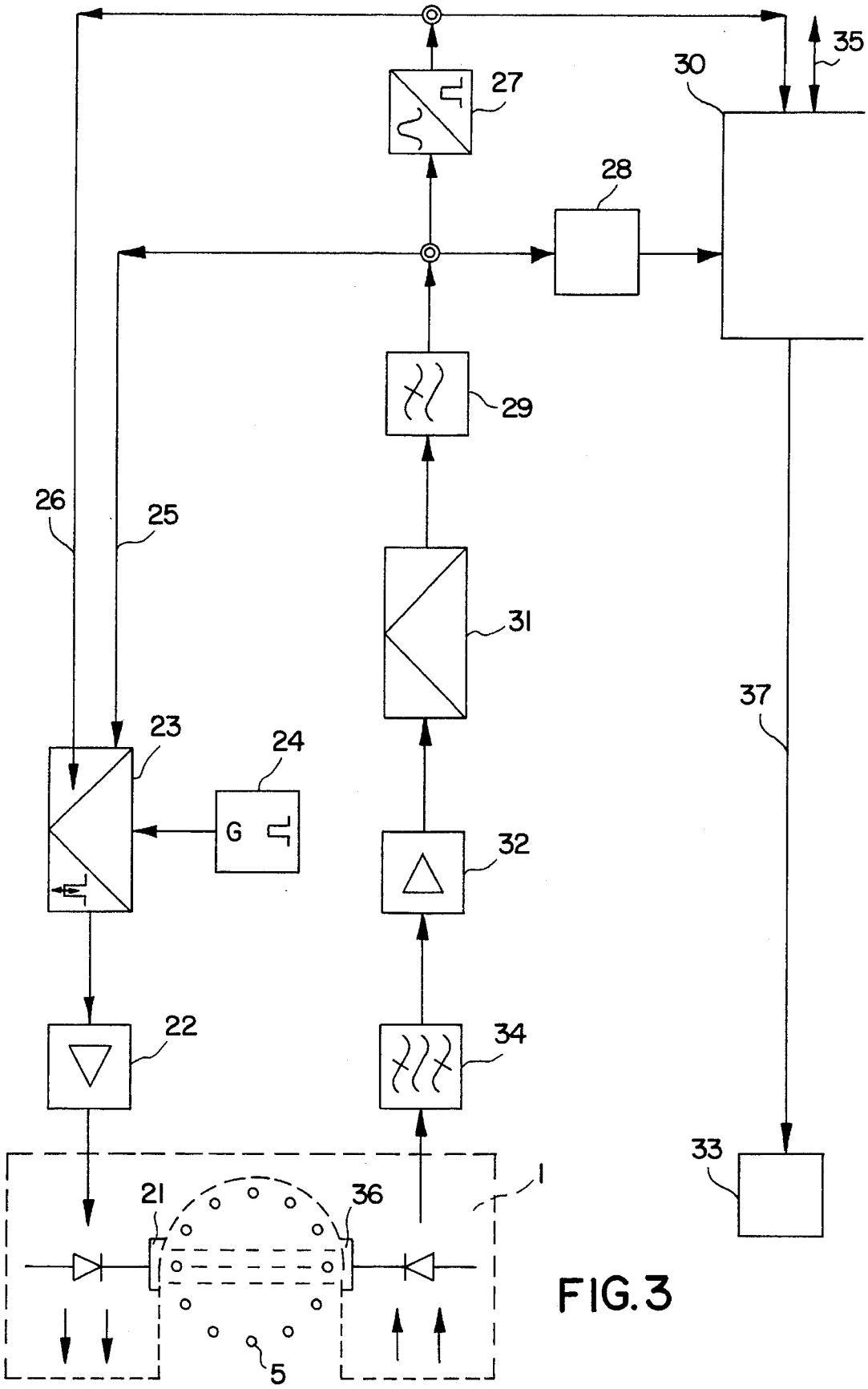
FIG. 3 is a block diagram showing the electronic circuits of the opto-electrical transducer by which the method of the present invention is implemented.
Figure 4:
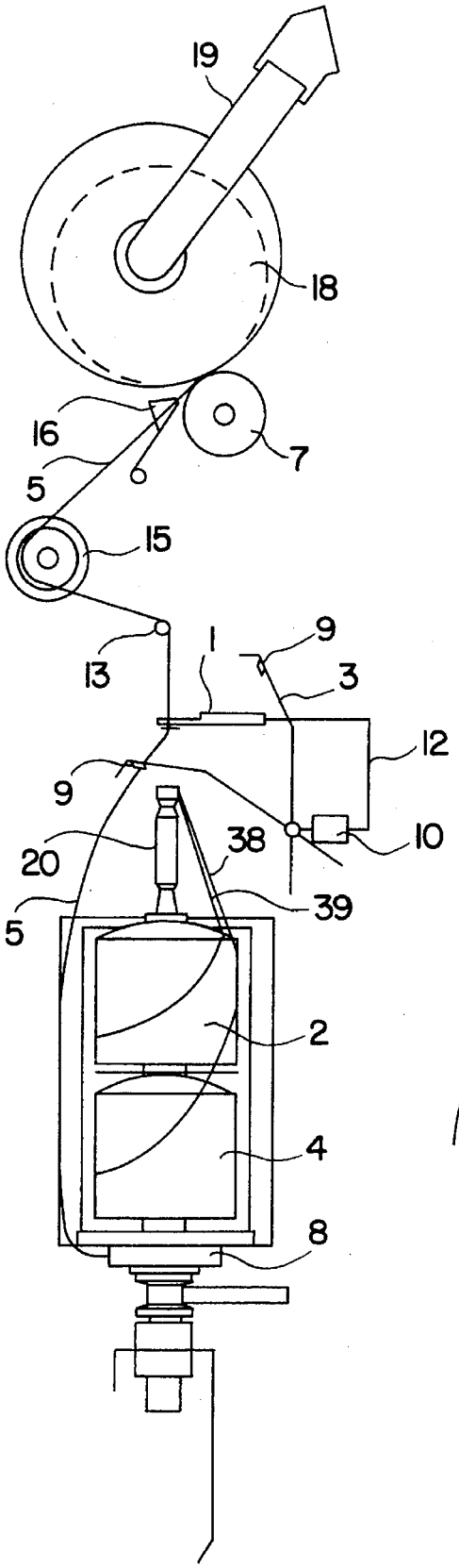
FIG. 4 is similar to FIG. 1 excluding the yarn guide eyelet.
Figure 5:
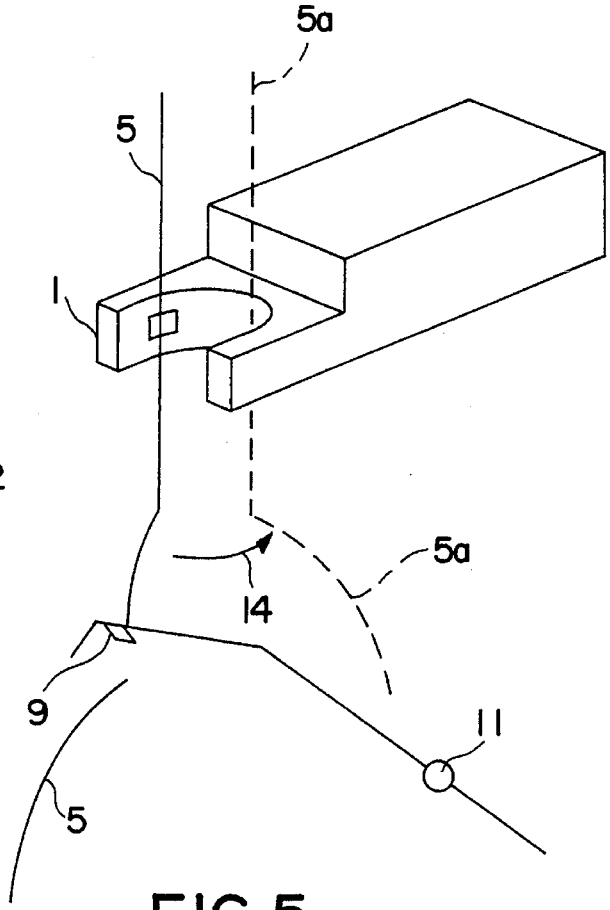
FIG. 5 is similar to FIG. 2 excluding the yarn guide eyelet.

In its continuous travel from the exit of the twisting spindle, the twisted yarn 5 is guided by the eyelet 6, which contains it while it undergoes circular movement in the direction of the arrow 14 between the positions indicated by 5 and 5a and vice versa (see FIG. 2).

Said circular movement of the twisted yarn 5 is present between the emitter 21 and receiver 36 of the opto-electrical transducer 1 of the present invention.

The emitter 21 emits a monitoring beam of inspection light which is projected onto the receiver 36.

The receiver is a photo diode, the signal which it receives being a signal amplitude-modulated by the presence of the twisted yarn 5.

At the receiver 36 said signal is filtered by the filter 34 to separate the useful signal from the optical interference of the surrounding environment. It then passes through the amplifier which sufficiently amplifies the signal to make it usable in the subsequent stages, i.e., it raises the signal to a level sufficient for subsequent processing.

It then passes through the demodulator 31, which extracts that signal part modulated by the presence of the twisted yarn and hence excludes the carrier part of the signal in order to ascertain moment by moment the soundness and quality of the twisted yarn 5 under observation. The signal then passes through the filter 29, which removes any residue in the output signal from the demodulator 31, i.e., it cleans the signal of any disturbance and makes it into direct linear form.

The output signal from the filter 29 branches into two different directions. In one direction it follows a passage through a pulse generator 27 which defines when the twisted yarn 5 is within or outside the emitted light beam, i.e., it converts the signal into binary logic pulses, i.e., within (YES) or outside (NO).

The pulse generator 27 then generates a signal which measures the passage frequency of the twisted yarn 5, i.e., its circular revolution rate, said signal thus indicating and monitoring the real revolutions of the twisting spindle per unit of time.

In the other direction the output signal from the filter 29 follows a passage through the analog-digital converter 28. Said converter 28 converts the analog signal into digital and hence into numerical form to be suitable for processing in the microprocessor block or electronic card 30.

The numerical processing of the signal enables the soundness and quality of the twisted yarn 5 to be verified and monitored, by determining the area subtended by the yarn presence signal 5. In the microprocessor 30 the said input signal provides moment-by-moment data in digital form, which are memorized, processed and compared with predetermined data keyed in by the operator at the machine head and transmitted through the serial line 35 to the input of the microprocessor 30. These latter predetermined data keyed in by the operator represent the regularity threshold for the twisted yarn under formation.

If during the twisting stage the twisted yarn falls outside the predetermined preset regularity threshold, the microprocessor 30 generates a signal which via the line 37 and block 33 generates a control signal which via the line 12 causes the actuator 10 to rotate the arm 3 with the cutting blade 9 about the pin 11, the blade lowering to cut the twisted yarn 5.

This cutting prevents any twisted yarn 5 unsuitable in terms of soundness or required quality depositing on the bobbin 18. In this respect, a twisted yarn 5 not meeting the preset quality level compromises subsequent proper unwinding of the twisted yarn with the result that the bobbin 18 cannot be used in the subsequent operations of the process necessary for obtaining the final product.

Said analog output signal from the filter 29 and said digital output signal from the pulse generator 27 return via respective lines 25 and 26 to the pulse modulator 23, which is fed by the pulse generator 24. Passage through the amplifier 22 follows, thus closing the loop monitoring the soundness and quality of the twisted yarn 5 between the emitter and receiver of the opto-electrical transducer 1 of the present invention.

Modifications of an applicational nature can be provided, in that the elements described and illustrated can be replaced by other equivalent elements, without leaving the scope of the inventive idea as hereinafter claimed.

We claim:

1. A method of monitoring the quality of a twisted yarn moving in a path from a double twist spindle, wherein the twisted yarn has a plurality of yarn plies, and wherein the method comprises:

a) detecting the presence of the twisted yarn as it undergoes circular movement transverse to its path by an optical detection means, and generating a signal corresponding thereto;

b) splitting said generated signal into a first signal and a second signal;

c) converting said first signal into binary logic pulses for measuring the amount of yarn twist per unit time;

d) converting said second signal into digital form for subsequent digital processing; and e) transmitting said converted first signal and said converted second signal to a processing means for determining if the twisted yarn is within a predetermined quality range.

2. A device for monitoring the quality of a twisted yarn moving in a path from a double twist spindle, wherein the twisted yarn has a plurality of yarn plies, and wherein the device comprises:

a) detection means for detecting the presence of the twisted yarn as it undergoes circular movement transverse to its path and generating a signal corresponding thereto;

b) splitting means for splitting said generated signal into a first signal and a second signal;

c) first converting means for converting said first signal into binary logic pulses for measuring the amount of yarn twist per unit time;

d) second converting means for converting said second signal into digital form for subsequent digital processing; and e) transmitting means for receiving and transmitting said converted first signal and said converted second signal to a processing means for determining if the twisted yarn is within a predetermined quality range.

3. The device of claim 2, wherein said detection means comprises an optical-electrical transducer and further comprising a yarn guide eyelet positioned upstream in the path from the spindle for determining the vertex formed by the yarn moving in its circular movement.

4. The device of claim 2, wherein said detection means comprises an optical-electrical transducer positioned upstream in the path from the spindle for determining the vertex formed by the yarn moving in its circular movement.

5. The device of claim 3, wherein said optical-electrical transducer comprises a light emitting diode for emitting modulated light for forming a measurement cell.

* * * * *

UNITED STATES PATENT AND TRADEMARK OFFICE

CERTIFICATE OF CORRECTION

PATENT NO. : 5,495,113

DATED : February 27, 1996

INVENTOR(S) : Badiali et al.

It is certified that error appears in the above-indentified patent and that said Letters Patent is hereby corrected as shown below:

Title page, item [75], Assignee should read -- SAVIO MACCHINE TESSILI S.R.L.--.

Signed and Sealed this

Twenty-ninth Day of October 1996

*Attest:*

Bruce Lehman

BRUCE LEHMAN

*Attesting Officer*

*Commissioner of Patents and Trademarks*